US008587621B2

(12) United States Patent
Malka et al.

(10) Patent No.: US 8,587,621 B2
(45) Date of Patent: Nov. 19, 2013

(54) SUB-PIXEL RENDERING OF A MULTIPRIMARY IMAGE

(75) Inventors: Doron Malka, Tel-Aviv (IL); Moshe Ben-Chorin, Rehovot (IL)

(73) Assignee: Genoa Color Technologies Ltd., Hod Hasharon (IL)

( * ) Notice: Subject to any disclaimer, the term of this patent is extended or adjusted under 35 U.S.C. 154(b) by 1064 days.

(21) Appl. No.: 12/095,004

(22) PCT Filed: Nov. 28, 2006

(86) PCT No.: PCT/IL2006/001368

§ 371 (c)(1),
(2), (4) Date: Dec. 23, 2008

(87) PCT Pub. No.: WO2007/060672

PCT Pub. Date: May 31, 2007

(65) Prior Publication Data

US 2009/0179826 A1 Jul. 16, 2009

Related U.S. Application Data

(60) Provisional application No. 60/739,935, filed on Nov. 28, 2005.

(51) Int. Cl.
*G09G 5/02* (2006.01)

(52) U.S. Cl.
USPC ..... 345/694; 345/32; 345/88

(58) Field of Classification Search
None
See application file for complete search history.

(56) References Cited

U.S. PATENT DOCUMENTS

| | | | |
|---|---|---|---|
| 3,699,244 | A | 10/1972 | Cohen et al. |
| 3,870,517 | A | 3/1975 | Ota et al. |
| 4,390,893 | A | 6/1983 | Russell et al. |
| 4,751,535 | A | 6/1988 | Myers |
| 4,800,375 | A | 1/1989 | Silverstein et al. |
| 4,838,655 | A | 6/1989 | Hunahata et al. |
| 4,843,381 | A | 6/1989 | Baron |
| 4,843,573 | A | 6/1989 | Taylor et al. |

(Continued)

FOREIGN PATENT DOCUMENTS

| | | |
|---|---|---|
| EP | 0 367 848 | 5/1990 |
| EP | 0 546 780 | 6/1993 |

(Continued)

OTHER PUBLICATIONS

International Search Report for International Application No. PCT/IL06/01368 mailed Jun. 5, 2008.

(Continued)

*Primary Examiner* — James Wozniak
*Assistant Examiner* — Antonio Xavier
(74) *Attorney, Agent, or Firm* — Pearl Cohen Zedek Latzer Baratz, LLP

(57) ABSTRACT

Methods and systems for displaying an image on a display, for example, a liquid crystal display (LCD) having more than three different colored filters. The display may include a plurality of sub-pixels, each of the sub-pixels being aligned with a filter having a color selected from a set of more than three different colors, none of which is white. A number of methods and systems for processing data for display are disclosed, for example, using data points from adjacent pixel groups, or data points for different colors within the same pixel data set.

25 Claims, 3 Drawing Sheets

(56) References Cited

U.S. PATENT DOCUMENTS 4,862,388 A * 8/1989 Bunker ..... 345/427
4,892,391 A 1/1990 Stewart et al.
4,952,972 A 8/1990 Someya
4,953,953 A 9/1990 Fergason
4,985,853 A 1/1991 Taylor et al.
4,994,901 A 2/1991 Parulski et al.
5,042,921 A 8/1991 Sato et al.
5,087,610 A 2/1992 Hed
5,184,114 A 2/1993 Brown
5,191,450 A 3/1993 Yajima et al.
5,214,418 A 5/1993 Fukumura et al.
5,233,183 A 8/1993 Field
5,233,385 A 8/1993 Sampsell
5,243,414 A 9/1993 Dalrymple et al.
5,375,002 A 12/1994 Kim et al.
5,416,890 A 5/1995 Beretta
5,447,811 A 9/1995 Buhr et al.
5,455,600 A 10/1995 Friedman et al.
5,563,621 A 10/1996 Silsby
5,563,725 A 10/1996 Kumada et al.
5,587,819 A 12/1996 Sunohara et al.
5,592,188 A 1/1997 Doherty et al.
5,614,925 A 3/1997 Braudaway et al.
5,631,734 A 5/1997 Stern et al.
5,642,176 A 6/1997 Abukawa et al.
5,643,176 A 7/1997 Persidsky
5,650,942 A 7/1997 Granger
5,657,036 A 8/1997 Markandey et al.
5,673,376 A * 9/1997 Ray et al. ..... 345/427
5,724,062 A 3/1998 Hunter
5,736,754 A 4/1998 Shi et al.
5,740,334 A 4/1998 Lin et al.
5,751,385 A 5/1998 Heinze
5,784,038 A 7/1998 Irwin
5,821,913 A 10/1998 Mamiya
5,835,099 A 11/1998 Marimont
5,841,492 A 11/1998 Iwauchi et al.
5,841,494 A 11/1998 Hall
5,844,540 A 12/1998 Terasaki
5,844,699 A 12/1998 Usami et al.
5,863,125 A 1/1999 Doany
5,870,530 A 2/1999 Balasubramanian
5,872,898 A 2/1999 Mahy
5,892,891 A 4/1999 Dalal et al.
5,896,178 A 4/1999 Inoue
5,909,227 A 6/1999 Silverbrook
5,936,617 A 8/1999 Uchino et al.
5,982,347 A 11/1999 Shigeta et al.
5,982,541 A 11/1999 Li et al.
5,999,153 A 12/1999 Lind et al.
6,018,237 A 1/2000 Havel
6,023,315 A 2/2000 Harrold et al.
6,040,876 A 3/2000 Pettitt et al.
6,054,832 A 4/2000 Kunzman et al.
6,058,207 A 5/2000 Tuijn et al.
6,069,601 A 5/2000 Lind et al.
6,072,464 A 6/2000 Ozeki
6,097,367 A 8/2000 Kuriwaki et al.
6,100,861 A 8/2000 Cohen et al.
6,115,016 A 9/2000 Yoshihara et al.
6,128,000 A * 10/2000 Jouppi et al. ..... 345/614
6,144,420 A 11/2000 Jung
6,147,720 A 11/2000 Guerinot et al.
6,160,596 A 12/2000 Sylvester et al.
6,185,003 B1 * 2/2001 Oyen ..... 358/1.9
6,191,826 B1 2/2001 Murakami et al.
6,198,512 B1 3/2001 Harris
6,220,710 B1 4/2001 Raj et al.
6,224,216 B1 5/2001 Parker et al.
6,231,190 B1 5/2001 Dewald
6,236,390 B1 5/2001 Hitchcock
6,236,406 B1 5/2001 Li
6,239,783 B1 5/2001 Hill et al.
6,243,070 B1 6/2001 Hill et al.
6,246,396 B1 6/2001 Gibson et al.
6,256,073 B1 7/2001 Pettitt
6,259,430 B1 7/2001 Riddle et al.
6,262,710 B1 7/2001 Smith
6,262,744 B1 7/2001 Carrein
6,280,034 B1 8/2001 Brennesholtz
6,304,237 B1 10/2001 Karakawa
6,324,006 B1 11/2001 Morgan
6,366,291 B1 4/2002 Taniguchi et al.
6,380,961 B1 4/2002 Van Der Loop et al.
6,384,839 B1 5/2002 Paul
6,388,648 B1 5/2002 Clifton et al.
6,407,766 B1 6/2002 Ramanujan et al.
6,452,595 B1 * 9/2002 Montrym et al. ..... 345/426
6,453,067 B1 9/2002 Morgan et al.
6,456,301 B1 9/2002 Huang
6,459,425 B1 10/2002 Holub et al.
6,467,910 B1 10/2002 Sato
6,498,592 B1 12/2002 Matthies
6,538,742 B1 3/2003 Ohsawa
6,570,584 B1 5/2003 Cok et al.
6,577,291 B2 6/2003 Hill et al.
6,580,482 B1 6/2003 Hiji et al.
6,594,387 B1 7/2003 Pettitt et al.
6,595,648 B1 7/2003 Woodgate et al.
6,633,302 B1 10/2003 Ohsawa et al.
6,687,414 B1 2/2004 Edgar
6,707,516 B1 3/2004 Johnson et al.
6,714,206 B1 * 3/2004 Martin et al. ..... 345/589
6,750,992 B1 6/2004 Holub
6,833,888 B2 12/2004 Song et al.
6,870,523 B1 3/2005 Ben-David et al.
6,882,384 B1 4/2005 Sharp
6,888,604 B2 5/2005 Rho et al.
6,897,876 B2 5/2005 Murdoch et al.
6,947,058 B1 * 9/2005 Elmquist ..... 345/611
6,952,194 B1 10/2005 Yamazaki et al.
6,954,191 B1 10/2005 Hirano et al.
6,954,216 B1 * 10/2005 Dowling et al. ..... 345/593
6,972,736 B1 12/2005 Wada et al.
6,980,176 B2 12/2005 Matsumoto et al.
7,129,955 B2 10/2006 Motomura
7,136,083 B2 11/2006 Tezuka et al.
7,139,058 B2 11/2006 Son et al.
7,206,005 B2 4/2007 Yamashita et al.
7,239,363 B2 7/2007 Park et al.
7,268,757 B2 9/2007 Ben-David et al.
7,289,174 B1 10/2007 Okumura et al.
7,352,488 B2 4/2008 Ben-Chorin et al.
7,362,393 B2 4/2008 Kim et al.
7,365,722 B2 4/2008 Lee
7,492,379 B2 2/2009 Credelle et al.
7,697,012 B2 4/2010 Lee et al.
7,932,880 B2 4/2011 Takahara et al.
2002/0005829 A1 1/2002 Ouchi
2002/0008714 A1 * 1/2002 Tezuka et al. ..... 345/694
2002/0015046 A1 2/2002 Okada et al.
2002/0024618 A1 2/2002 Imai
2002/0051111 A1 5/2002 Greene et al.
2002/0054424 A1 5/2002 Miles
2002/0060689 A1 5/2002 Iwata et al.
2002/0061369 A1 5/2002 Kunimatsu et al.
2002/0097365 A1 7/2002 Yang et al.
2002/0109821 A1 8/2002 Huibers et al.
2002/0122019 A1 9/2002 Baba et al.
2002/0149546 A1 10/2002 Ben-Chorin et al.
2002/0163526 A1 11/2002 Haseltine et al.
2002/0167528 A1 11/2002 Edge
2002/0186229 A1 12/2002 Brown Elliott
2002/0191130 A1 12/2002 Liang et al.
2003/0034992 A1 * 2/2003 Brown Elliott et al. ..... 345/690
2003/0085906 A1 5/2003 Elliott et al.
2003/0117409 A1 * 6/2003 Lefebvre et al. ..... 345/581
2003/0117423 A1 6/2003 Brown Elliott et al.
2003/0146891 A1 8/2003 Poliakine
2003/0160915 A1 8/2003 Liu
2003/0189410 A1 10/2003 Yamazaki et al.
2003/0210409 A1 * 11/2003 Huang et al. ..... 358/1.1
2004/0046725 A1 3/2004 Lee
2004/0061877 A1 * 4/2004 Bhattacharjya ..... 358/1.8

(56) References Cited

U.S. PATENT DOCUMENTS

| | | | | |
|---|---|---|---|---|
| 2004/0174389 | A1* | 9/2004 | Ben-David et al. | 345/694 |
| 2004/0177323 | A1 | 9/2004 | Kaasila et al. | |
| 2004/0212633 | A1 | 10/2004 | Natori et al. | |
| 2004/0222999 | A1 | 11/2004 | Choi et al. | |
| 2004/0246389 | A1* | 12/2004 | Roth | 349/5 |
| 2005/0056768 | A1* | 3/2005 | Oldham et al. | 250/208.1 |
| 2005/0122294 | A1 | 6/2005 | Ben-David et al. | |
| 2005/0134785 | A1* | 6/2005 | Roth et al. | 349/144 |
| 2005/0140636 | A1 | 6/2005 | Chung et al. | |
| 2005/0140907 | A1 | 6/2005 | Yun | |
| 2005/0162358 | A1 | 7/2005 | Song et al. | |
| 2005/0270444 | A1 | 12/2005 | Miller et al. | |
| 2006/0001688 | A1* | 1/2006 | Chabreck et al. | 347/19 |
| 2006/0038953 | A1 | 2/2006 | Moriya | |
| 2006/0061590 | A1* | 3/2006 | Akenine-Moller et al. | 345/611 |
| 2006/0132511 | A1* | 6/2006 | Feng | 345/694 |
| 2006/0221026 | A1* | 10/2006 | Roth et al. | 345/88 |
| 2007/0001994 | A1 | 1/2007 | Roth | |
| 2007/0008336 | A1* | 1/2007 | Bastos et al. | 345/613 |
| 2007/0052887 | A1 | 3/2007 | Brown Elliot et al. | |
| 2007/0064178 | A1 | 3/2007 | Murai | |
| 2007/0176948 | A1* | 8/2007 | Ben-David et al. | 345/690 |
| 2007/0210987 | A1* | 9/2007 | Hashimoto et al. | 345/60 |
| 2008/0024410 | A1 | 1/2008 | Ben-David et al. | |
| 2008/0030447 | A1 | 2/2008 | Ben-David et al. | |
| 2008/0084365 | A1 | 4/2008 | Takahara et al. | |
| 2008/0316235 | A1* | 12/2008 | Okazaki et al. | 345/694 |

FOREIGN PATENT DOCUMENTS

| | | |
|---|---|---|
| EP | 0 547 603 | 6/1993 |
| EP | 0 653 879 | 5/1995 |
| EP | 0 831 451 | 3/1998 |
| EP | 1 087 341 | 3/2001 |
| GB | 2 139 393 | 11/1984 |
| JP | 59-159131 | 9/1984 |
| JP | 60-263122 | 12/1985 |
| JP | 62-222774 | 9/1987 |
| JP | 03-92888 | 4/1991 |
| JP | 07-043658 | 2/1995 |
| JP | 08-248410 | 9/1996 |
| JP | 08-280038 | 10/1996 |
| JP | 09-230301 | 9/1997 |
| JP | 09-251160 | 9/1997 |
| JP | 10-063203 | 3/1998 |
| JP | 10-307205 | 11/1998 |
| JP | 11-052327 | 2/1999 |
| JP | 2000-116789 | 4/2000 |
| JP | 2000-171799 | 6/2000 |
| JP | 2000-253263 | 9/2000 |
| JP | 2000-321993 | 11/2000 |
| JP | 2000-338950 | 12/2000 |
| JP | 2000-347324 | 12/2000 |
| JP | 2001-209047 | 8/2001 |
| JP | 2001-255520 | 9/2001 |
| JP | 2001-306023 | 11/2001 |
| JP | 2002-091369 | 3/2002 |
| JP | 2002-149148 | 5/2002 |
| JP | 2002-318564 | 10/2002 |
| WO | WO 95/10160 | 4/1995 |
| WO | WO 97/35424 | 9/1997 |
| WO | WO 97/40621 | 10/1997 |
| WO | WO 97/42770 | 11/1997 |
| WO | WO 01/37249 | 5/2001 |
| WO | WO 01/95544 | 12/2001 |
| WO | WO 02/11112 | 2/2002 |
| WO | WO 02/50763 | 6/2002 |
| WO | WO 02/091299 | 11/2002 |
| WO | WO 02/091348 | 11/2002 |
| WO | WO 02/091349 | 11/2002 |
| WO | WO 02/099557 | 12/2002 |
| WO | WO 02/101644 | 12/2002 |
| WO | WO 03/058587 | 7/2003 |
| WO | WO 03/088203 | 10/2003 |
| WO | WO 2005/057532 | 6/2005 |

OTHER PUBLICATIONS

U.S. Appl. No. 60/255,914, filed Dec. 19, 2000, Ben-David et al.

Ajito et al., "Multiprimary Color Display for Liquid Crystal Display Projectors Using Diffraction Grating", Optical Eng. 38(11) 1883-1888, Nov. 1999.

Ajito et al. "Expanded Color Gamut Reproduced by Six-Primary Projection Display", Proc. SPIE, vol. 3954, pp. 130-137, 2000.

Ajito et al., "Color Conversion Method for Multiprimary Display Using Matrix Switching", Optical Review, vol. 9, No. 3, pp. 191-197, Dec. 2001.

Betrisey et al., "20.4: Displaced Filtering for Patterned Displays", Microsoft Corporation, Society for Information Display, SID, pp. 1-4, 2000.

Credelle et al., "9-2: MTF of High-Resolution PenTile Matrix Displays", Eurodisplay pp. 159-162, 2002.

Daly Scott, "47.3: Analysis of Subtriad Addressing Algorithms by Visual System Models" Center for Display Appearance, Sharp Laboratories of America, Camas, WA, USA, SID, pp. 1200-1203, 2001.

Brown Elliott et al., "Color Subpixel Rendering Projectors and Flat Panel Displays", SMPTE Advanced Motion Imaging Conference, Feb. 27-Mar. 1, 2003, Seattle, Washington, USA, pp. 1-4.

Brown Elliott et al., "13.3: Co-Optimization of Color AMLCD Subpixel Architecture and Rendering Algorithms", ClairVoyante Laboratories, Inc., USA and AMLCD Division, Semiconductor Business, Korea, pp. 1-4.

Brown Elliott, "Active Matrix Display Layout Optimization for Sub-Pixel Image Rendering", Clair Voyante Laboratories, Inc., USA, pp. 1-5.

Hiyama et al., "LN-3: Four-Primary Color 15-in. XGA TFT-LCD with Wide Color Gamut", Japan, Eurodisplay 2002, pp. 827-830.

Horibe et al., "High Efficiency and High Visual Quality LCD Backlighting System", Faculty of Science and Technology, Keio University, Japan, pp. 1-4.

Imai Francisco H., "Spectral Reproduction from Scene to Hardcopy", Part I-Multi-Spectral Acquisition and Spectral Estimation using a Trichromatic Digital Camera System Associated with Absorption Filters, Color Science.

Keith Jack, "Video Demystified", 3rd Edition, LLH Technology Publishing, 2001.

Klompenhouwer et al., "13.4: Subpixel Image Scaling for Color Matrix Displays", Phillips Research Laboratories, Eindhoven, The Netherlands, SID, pp. 176-179, 2002.

Kwak et al., "Accurate prediction of Colours on Liquid Crystal Displays", Color Science and Engineering: System, Technologies, Applications: Final Program and Proceeding of IS&T and SID Ninth Color Imaging Conference, IS&T, Springfield, VA, US, vol. 9, Nov. 1, 2001, pp. 355-359.

"Parameter Values for the HDTV Standards for Production and International Programme Exchange", Rec. ITU-R BT.709-3, (1990-1994-1995-1998), pp. 1-28.

Platt, J., "Optimal Filtering for Patterned Displays", Microsoft Research, pp. 1-4.

Pointer, M. R., "The Gamut of Real Surface Colors", Color Research & Appl. 5(3): 145-155, 1980.

Rosen et al., "Spectral Reproduction from Scene to Hardcopy II", Image Processing. Munsell Color Science Laboratory, RIT-Proceedings of SPIE vol. 4300 (2001), pp. 33-41.

Sharma, "LCDs Versus CRTs—Color-Calibration and Gamut Considerations", Proceedings of the IEEE, New York, US, vol. 90, No. 4, Apr. 1, 2002, pp. 605-622.

Shimizu A. Jeffrey, "40.1: Invited Paper: Scrolling Color LCOS for HDTV Rear Projection", SID 01 Digest, pp. 1072-1075.

"Sub-Pixel Front Rendering Technology", http://www.grc.com/cleartype.htm, pp. 1-2.

Sugiura et al., "P-24:LCD Module Adopting a Color Conversion Circuit", Japan, SID, pp. 288-291, 2002.

Sugiura, T., "11.4: Invited Paper: EBU Color Filter for LCD's", Toppan Printing Co., Ltd., Japan, SID, pp. 146-149, 2001.

(56) References Cited

OTHER PUBLICATIONS

Takatori et al., "6.3: Field-Sequential Smectic LCD with TFT Pixel Amplifier ", Functional Devices Research Labs , NEC Corp, Kawasaki, Kawasaki, Kanagawa 216-8555, Japan, SID 01 Digest.
Tsai et al., "Color Reproduction of Twist Nematic LCD by Polynomial Regression Applied in Primary-Invariance Model", 1999 SID International Symposium, San Jose, California, pp. 1-4, May 18-20, 1999.
Wyble et al. "A Critical Review of Spectral Models Applied to Binary Color Printing", Color Research and Application, vol. 25, No. 1, Feb. 2000, pp. 4-19.
Wyzecki et al. "Concepts and Methods, Quantitative Data and Formulae" 2d Ed., pp. 179-183, 1982.
Yamada et al., "12.1:LED Backlight for LCD's", IBM Research, Tokyo Research Laboratory, Yamato, Japan, SID pp. 1-4, 1998.
Yamaguchi et al. "Color image reproduction based on the multispectral and Multiprimary imaging: Experimental evaluation", Device Independent Color, Color Hardcopy and applications VII, Proc SPIE, vol. 4663, pp. 15-26 (2002).
Notice of Allowance issued by the United States Patent and Trademark Office for U.S. Appl. No. 10/480,280 dated Jun. 19, 2007.
Notice of Allowance issued by the United States Patent and Trademark Office for U.S. Appl. No. 11/882,491 dated Dec. 3, 2010.
Notice of Allowance issued by the United States Patent and Trademark Office for U.S. Appl. No. 11/882,491 dated Mar. 31, 2011.
Office Action issued by the United States Patent and Trademark Office for U.S. Appl. No. 11/882,170 dated Aug. 3, 2010.
Notice of Allowance issued by the United States Patent and Trademark Office for U.S. Appl. No. 11/882,170 dated Dec. 22, 2010.
Notice of Allowance issued by the United States Patent and Trademark Office for U.S. Appl. No. 11/882,170 dated Mar. 18, 2011.
Office Action issued by the United States Patent and Trademark Office for U.S. Appl. No. 12/103,269 dated Jul. 17, 2009.
Office Action issued by the United States Patent and Trademark Office for U.S. Appl. No. 12/103,269 dated Jan. 6, 2010.
Office Action issued by the United States Patent and Trademark Office for U.S. Appl. No. 12/103,269 dated Jul. 15, 2010.
Office Action issued by the United States Patent and Trademark Office for U.S. Appl. No. 13/194,510 dated Dec. 23, 2011.
Notice of Allowance issued by the United States Patent and Trademark Office for U.S. Appl. No. 13/194,510 dated May 21, 2012.
Office Action issued by the United States Patent and Trademark Office for U.S. Appl. No. 10/492,616 dated Jun. 24, 2009.
Office Action issued by the United States Patent and Trademark Office for U.S. Appl. No. 10/492,616 dated Dec. 17, 2009.
Office Action issued by the United States Patent and Trademark Office for U.S. Appl. No. 10/492,616 dated Mar. 26, 2010.
Office Action issued by the United States Patent and Trademark Office for U.S. Appl. No. 10/492,616 dated Jan. 21, 2011.
Office Action issued by the United States Patent and Trademark Office for U.S. Appl. No. 11/009,515 dated Aug. 20, 2007.
Office Action issued by the United States Patent and Trademark Office for U.S. Appl. No. 11/009,515 dated Mar. 17, 2008.
Notice of Allowance issued by the United States Patent and Trademark Office for U.S. Appl. No. 11/009,515 dated Sep. 8, 2008.
Office Action issued by the United States Patent and Trademark Office for U.S. Appl. No. 11/882,452 dated Apr. 2, 2008.
Notice of Allowance issued by the United States Patent and Trademark Office for U.S. Appl. No. 11/882,452 dated Oct. 6, 2008.
Office Action issued by the United States Patent and Trademark Office for U.S. Appl. No. 12/359,483 dated Aug. 4, 2009.
Office Action issued by the United States Patent and Trademark Office for U.S. Appl. No. 12/359,483 dated Feb. 3, 2010.
Office Action issued by the United States Patent and Trademark Office for U.S. Appl. No. 12/359,483 dated Jun. 14, 2011.
Office Action issued by the United States Patent and Trademark Office for U.S. Appl. No. 12/359,483 dated Nov. 21, 2011.
Notice of Allowance issued by the United States Patent and Trademark Office for U.S. Appl. No. 12/359,483 dated Jan. 4, 2012.
Office Action issued by the United States Patent and Trademark Office for U.S. Appl. No. 12/909,742 dated Jul. 25, 2012.
Office Action issued by the United States Patent and Trademark Office for U.S. Appl. No. 10/588,755 dated Apr. 30, 2009.
Office Action issued by the United States Patent and Trademark Office for U.S. Appl. No. 10/588,755 dated Oct. 20, 2009.
Office Action issued by the United States Patent and Trademark Office for U.S. Appl. No. 10/588,755 dated Apr. 22, 2010.
Office Action issued by the United States Patent and Trademark Office for U.S. Appl. No. 10/588,755 dated Nov. 15, 2010.
Office Action issued by the United States Patent and Trademark Office for U.S. Appl. No. 10/588,755 dated Jun. 17, 2011.
Office Action issued by the United States Patent and Trademark Office for U.S. Appl. No. 10/543,511 dated Jul. 7, 2009.
Office Action issued by the United States Patent and Trademark Office for U.S. Appl. No. 10/543,511 dated Mar. 24, 2010.
Notice of Allowance issued by the United States Patent and Trademark Office for U.S. Appl. No. 10/543,511 dated Dec. 17, 2010.
Office Action issued by the United States Patent and Trademark Office for U.S. Appl. No. 10/543,511 dated Jun. 27, 2011.
Office Action issued by the United States Patent and Trademark Office for U.S. Appl. No. 10/543,511 dated Dec. 14, 2011.
Notice of Allowance issued by the United States Patent and Trademark Office for U.S. Appl. No. 10/543,511 dated Mar. 21, 2012.

* cited by examiner

SUB-PIXEL RENDERING OF A MULTIPRIMARY IMAGE

CROSS-REFERENCE TO RELATED APPLICATIONS

This application is a National Phase Application of PCT International Application No. PCT/IL2006/001368, entitled "SUB-PIXEL RENDERING OF A MULTIPRIMARY IMAGE", International Filing Date Nov. 28, 2006, published on May 31, 2007 as International Publication No. WO 2007/060672, which in turn claims priority from U.S. Provisional Patent Application No. 60/739,935, filed Nov. 28, 2005, both of which are incorporated herein by reference in their entirety.

FIELD OF THE INVENTION

The invention relates generally to multi-primary color displays and, more particularly, to multi-primary Liquid Crystal Displays (LCDs).

BACKGROUND

FIG. 1 schematically illustrates a conventional color Liquid Crystal Display (LCD) system 100. System 100 may include an array 108 of liquid crystal (LC) elements (cells) 104, for example, an LC array using Thin Film Transistor (TFT) active-matrix technology, as is known in the art, and a tri-color filter array, e.g., a RGB filter array 106, which may be juxtaposed with LC array 108. System 100 may also include a first set of electronic circuits ("row drivers") 110 and a second set of electronic circuits ("column drivers") 130 for driving the LC array cells, e.g., by active-matrix addressing, as is known in the art. In existing LCD devices, each full-color pixel of the displayed image is reproduced by three sub-pixels, each sub-pixel corresponding to a different primary color, e.g., each pixel is reproduced by driving a respective set of R, G and B sub-pixels. For each sub-pixel there is a corresponding cell in LC array 108. The transmittance of each of the sub-pixels is controlled by the voltage applied to the corresponding LC cell, based on RGB data input 119 for the corresponding pixel. A timing controller (TCON) 118 receives the input RGB data and adjusts the magnitude of a signal 123 delivered to the different column drivers 130 based on the input data for each pixel. TCON 118 may also provide drivers 110 with a timing signal 121 to controllably activate rows of LC array 108, as is known in the art. The intensity of white light, e.g., provided by a back-illumination source, may be spatially modulated by LC array 108, selectively attenuating the light for each sub pixel according to the desired intensity of the sub-pixel. The selectively attenuated light passes through RGB color filter array 106, wherein each LC cell is in registry or in alignment with a corresponding color sub-pixel, producing the desired color sub-pixel combinations. The human vision system spatially integrates the light filtered through the different color sub-pixels to perceive a color image.

SUMMARY OF EMBODIMENTS OF THE INVENTION

Embodiments of the invention may provide for a method for displaying an image on a display having a plurality of sub-pixels, each of the sub-pixels being aligned with a filter having a color selected from a set of more than three different colors, none of which is white, comprising providing first and second pixel data sets, which pixel data sets each have more than three data points and correspond to first and second adjacent pixel groups respectively, the pixel groups including a plurality of sub-pixels, and for at least one sub-pixel in the first pixel group, calculating an intensity value based at least on a first data point included in the first pixel data set and corresponding to the color of the filter aligned with the sub-pixel, and a second data point, the second data point included in the second pixel data set.

Some embodiments of the invention may provide a method for displaying an image on a display having a plurality of sub-pixels, each of the sub-pixels being aligned with a filter having a color selected from a set of more than three different non-white colors, the method comprising providing a pixel data set having more than three data points and corresponding to a pixel group, and for at least one sub-pixel in the pixel group, providing an intensity value for the sub-pixel based at least on a data point in the data set corresponding to the color of the filter aligned with said sub-pixel and a second data point included in the data set corresponding to a color different from the color of the filter aligned with the sub-pixel. In some embodiments of the invention, the method may be practiced where each of the pixel groups includes fewer sub-pixels than the number of data points in the pixel data sets. The number of data points in the pixel data sets may correspond to the number of primary or fundamental colors in the display, which in varying embodiments may be, for example, four, five, six, or more colors. In some embodiments, the second point in the data set may correspond to a color that is not represented in the pixel group, for example, for which there is no filter aligned with any sub-pixels in the pixel group.

In some embodiments of the invention, the method may also include receiving first and second three-color data sets, each of said three-color data sets including exactly three data points and/or converting the first and second three-color data sets using a conversion algorithm to obtain said pixel data set, each of the second pixel data sets including more than three data points.

In some embodiments of the invention, the intensity value of the sub-pixel may be further based on yet a third data point, which corresponds to a color different than the color of the filter aligned with said sub-pixel. The third data point may be taken from the first data set, or from a data set corresponding to an adjacent pixel group.

The method may use a variety of weighting algorithms to calculate the various weights to give to the intensity value of the sub-pixel. A simple weighing may be calculated, or in some embodiments, a convolution algorithm for re-sampling a data set based on weights given to the different data points in different adjacent pixel groups may be used. Data points from any number of adjacent pixel groups may be used, for example, one pixel to one side of the pixel group being displayed, and two or three pixels to the other side of the pixel group being displayed. Data points in the additional data sets used for the calculation may correspond to the color of the sub-pixel being displayed, or may correspond to a different color.

The method may be used to calculate the intensity values of one or some or all sub-pixels in a pixel group. In some embodiments, the intensity value of at least one sub-pixel in a pixel group, for example, the sub-pixel at a center of the pixel group, may be calculated using solely the data point in the data set corresponding to the color of the filter aligned with the sub-pixel. The method may be used to calculate intensity values for some or all of the pixel groups in the display.

Some embodiments of the invention may provide a system comprising a display having a plurality of sub-pixels, each the sub-pixels aligned with a corresponding color filter, wherein the display includes filters having more than three different colors, none of said colors being white, a data converter to convert a first data set having exactly three data points to a second data set having more than three data points, wherein the second data set corresponds to a pixel group including a plurality of sub-pixels on said display, and a scaling processor to calculate for at least a portion of sub-pixels in each pixel group corresponding to the second data set an intensity value based at least on a data point in the second data set corresponding to the color of said sub-pixel and a data point in an additional data set. Some systems in accordance with embodiments of the invention may further include a timing controller to provide said intensity values to sub-pixels. In some systems in accordance with embodiments of the invention, the sub-pixels are liquid crystal elements. In some embodiments of the invention, the liquid crystal elements are controlled by thin film transistors. In some embodiments of the invention, the number of sub-pixels in each pixel group may be fewer than the number of different fundamental or primary colors in the display.

In some embodiments of the invention, the scaling processor may be to calculate the intensity value for the sub-pixel based at least on the data point in the additional data set, wherein the data point in the additional data set corresponds within the additional data set to the color of the filter aligned with the sub-pixel. In some embodiments, the scaling processor may be to calculate the intensity value based on a weighted average of the data point in the second data set and the data point in the additional data set. In some embodiments, the scaling processor may be to calculate for another portion of sub-pixels in the pixel group, for example, for one or more sub-pixels in the center of the pixel group, an intensity value based solely on a data point in said second data set corresponding to the color of said sub-pixel.

According to some embodiments of the invention, a system may be provided comprising a display having a plurality of sub-pixels, each of the sub-pixel aligned with a corresponding color filter, wherein the display includes filters having more than three different colors, none of the colors being white, a data converter to convert a first data set having exactly three data points to a second data set having more than three data points, wherein the second data set corresponds to a pixel group including a plurality of sub-pixels on the display, and a scaling processor to calculate for at least a portion of sub-pixels in each pixel group corresponding to the second data set an intensity value based at least on a data point in the second data set corresponding to the color of said sub-pixel and a second data point in the second data set corresponding to a color different than the color of said sub-pixel, wherein the different color is not among the filters aligned with any of the sub-pixels in the pixel group. In some embodiments of the invention, the number of sub-pixels in each pixel group may be fewer than the number of different colors in the display.

BRIEF DESCRIPTION OF THE DRAWINGS

The invention will be understood and appreciated more fully from the following detailed description of embodiments of the invention, taken in conjunction with the accompanying drawings of which.

Figure 1:
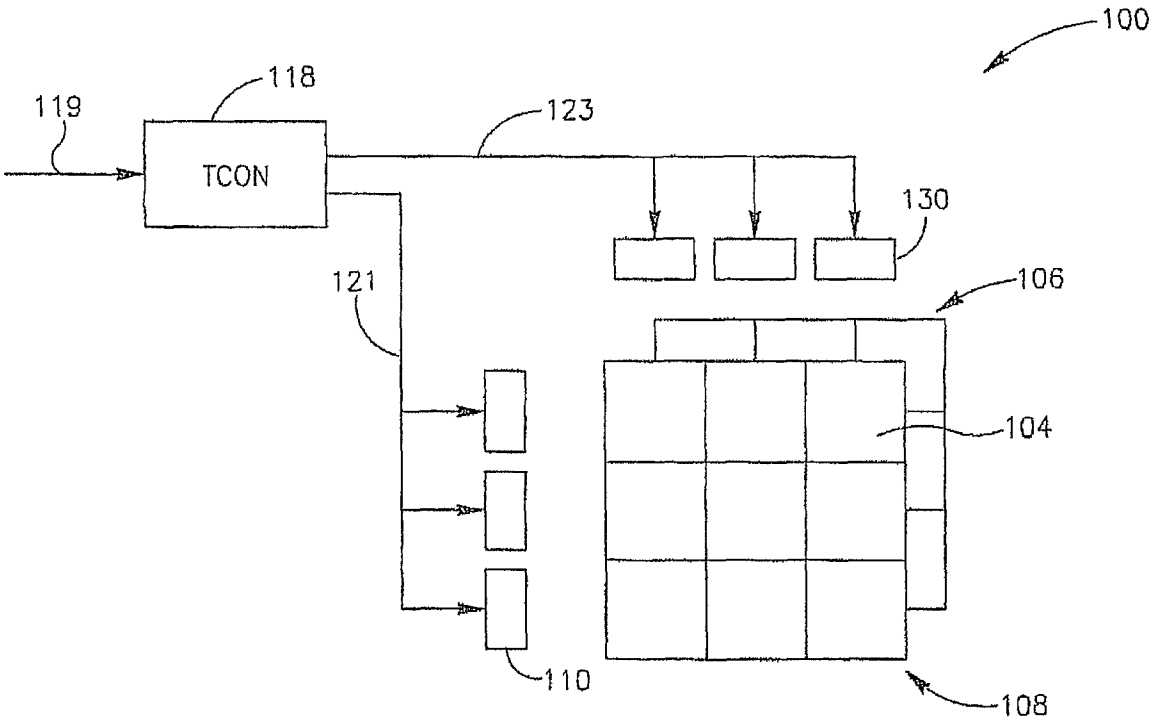
FIG. 1 PRIOR ART
FIG. 1 is a schematic block diagram of a conventional LCD color display system.

It will be appreciated that for simplicity and clarity of illustration, elements shown in the figures have not necessarily been drawn accurately or to scale. For example, the dimensions of some of the elements may be exaggerated relative to other elements for clarity or several physical components included in one element. Further, where considered appropriate, reference numerals may be repeated among the figures to indicate corresponding or analogous elements. It will be appreciated that these figures present examples of embodiments of the present invention and are not intended to limit the scope of the invention.

DETAILED DESCRIPTION OF SOME DEMONSTRATIVE EMBODIMENTS OF THE INVENTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details presented herein. Furthermore, some features of the invention relying on principles and implementations known in the art may be omitted or simplified to avoid obscuring the present invention.

Unless specifically stated otherwise, as apparent from the following discussions, it is appreciated that throughout the specification discussions utilizing terms such as "processing", "computing", "calculating", "determining", or the like, refer to the action and/or processes of an electronic circuit or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices. In addition, the term "plurality" may be used throughout the specification to describe two or more components, devices, elements, parameters and the like.

Some embodiments of the invention may be implemented, for example, using a machine-readable medium or article which may store an instruction or a set of instructions that, if executed by a machine (for example, by a processor and/or by other suitable machines), cause the machine to perform a method and/or operations in accordance with embodiments of the invention. Such a machine may include, for example, any suitable processing platform, computing platform, computing device, processing device, computing system, processing system, computer, processor, Application Specific Integrated Circuit (ASIC), Field-Programmable Gate Array (FPGA), or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, various types of Digital Versatile Disks (DVDs), a tape, a cassette, or the like. The instructions may include any suitable type of code, for example, source code, compiled code, interpreted code, executable code, static code, dynamic co-de, or the like, and may be implemented using any suitable high-level, low-level, object-oriented, visual, compiled and/or interpreted programming language, e.g., C, C++, Java, BASIC, Pascal, Fortran, Cobol, assembly language, machine code, VHDL or the like.

Embodiments of the invention include a device, system and/or method of controllably activating drivers of an array of sub-pixel elements of n-primary colors, wherein n is greater than three.

According to some exemplary embodiments of the invention, the drivers may be controllably activated based on one or more display attributes and/or one or more image attributes, as described in detail below.

It will be appreciated that the term "display attributes" as used herein may refer to one or more attributes of a color display device, for example, a configuration of one or more sub-pixel elements within an array of sub-pixel elements of the display, a configuration of one or more defective sub-pixel elements within the array, a brightness and/or color non-homogeneity of the display device, and/or any other objective, subjective or relative attribute, which may be related to the display device.

It will be appreciated that the term "image attributes" as used herein may refer to one or more attributes related to at least part of a displayed color image, or a color image to be displayed, for example, a perceived bit-depth of pixels of at least part of the color image, a viewed smoothness of at least part of the color image, a brightness and/or color uniformity of at least part of the color image, a rendering scheme to be applied to at least part of the color image, and/or any other objective, subjective or relative attribute, which may be related to the color image.

Certain aspects of monitors and display devices with more than three primaries, in accordance with exemplary embodiments of the invention, are described in International Application PCT/IL02/00452, filed Jun. 11, 2002, entitled "DEVICE, SYSTEM AND METHOD FOR COLOR DISPLAY" and published 19 Dec. 2002 as PCT Publication WO 02/101644, and in International Application PCT/IL02/00307, filed Apr. 13, 2003, entitled "COLOR DISPLAY DEVICES AND METHODS WITH ENHANCED ATTRIBUTES" and published 23 Oct. 2003 as PCT Publication WO03/088203, the disclosure of which are incorporated herein by reference.

Some demonstrative embodiments of the invention may be implemented, for example, using a multi-primary (MP) display device having a Liquid Crystal display (LCD) panel, which may include, for example, an array of liquid crystal (LC) elements (cells), e.g., a LC array using Thin Film Transistor (TFT) active-matrix technology, as is known in the art. The panel may also include a controller to activate sub-pixels of the LC array according to a three-primary sub-pixel data configuration. For example, the LCD panel may include a standard backplane TFT for RGB LCD panel ("the standard RGB LCD").

According to some demonstrative embodiments of the invention, the device may also include an array of four or more MP sub-pixel filters juxtaposed is with the LC array; and a sub-pixel processor to receive four-or-more primary image data and provide the controller with corresponding data in the three-primary sub-pixel configuration, e.g., as described in detail below.

According to some demonstrative embodiments of the invention, the above-described device may be manufactured at a relatively low cost, for example, by modifying a standard RGB LCD, e.g., instead of re-designing the TFT backplane of the LCD panel. For example, a standard RGB filter array of the standard LCD may be replaced by the array of four or more MP sub-pixel filters. According to an embodiment of the invention, a MP LCD display may include a plurality of sub-pixels having more than three different filters, for example, red, green, blue, and yellow. In an embodiment of the invention, a display may have filters colored red, green, blue, yellow and cyan. In an embodiment of the invention, a display may have filters colored red, green, blue, yellow, cyan and magenta. In exemplary embodiments of the invention, none of the filters is white. In conventional TFT backplanes, the aspect ratio of a sub-pixel is approximately 3:1, such that a group of sub-pixels of three different colors make up a pixel having aspect ratio of approximately 1:1. In exemplary embodiments of the invention, for example, where a standard RGB LCD is modified by replacing the RGB filters by an array of filters having more than three different colors, as described above, the aspect ratio of a group of sub-pixels including all of the more than three different colors may have an aspect ratio of 3:4 or 3:5 or 3:6, for four, five or six colors, respectively. Accordingly, the methods and systems described herein may compensate for such distortion.

Figure 2:
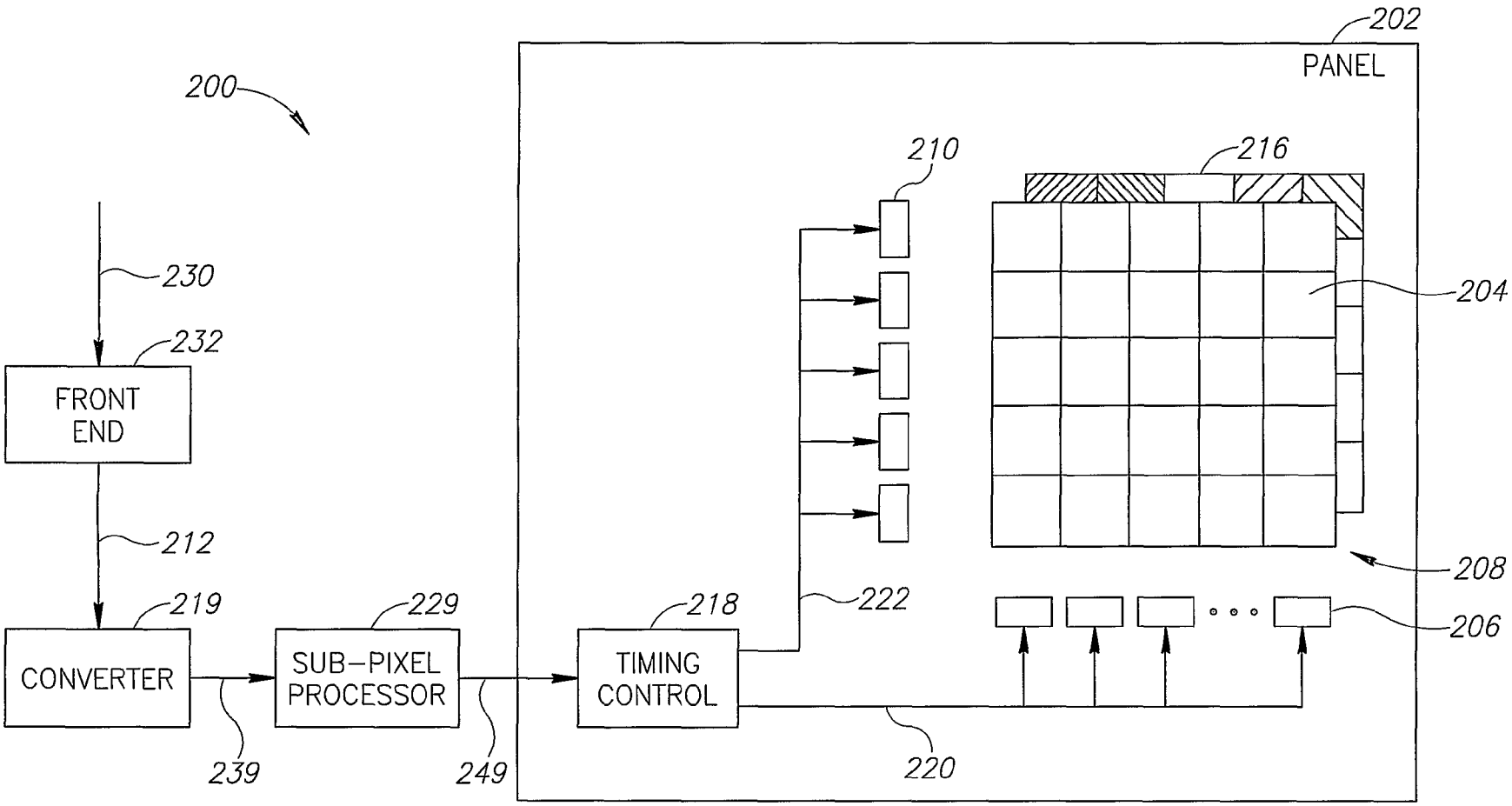
FIG. 2 is a schematic block diagram of a multi-primary color display system in accordance with exemplary embodiments of the invention.

Reference is made to FIG. 2, which schematically illustrates an n-primary color display system 200 to display a color image, e.g., based on a three-primary video input signal 212, in accordance with exemplary embodiments of the invention.

According to some demonstrative embodiments of the invention, system 200 may include a front-end module 232. Module 232 may include, for example, an analog-to-digital ("A/D") converter to convert an analog video input signal 230 into digital video input signal 212, as is known in the art. According to other exemplary embodiments signal 230 may include a digital video input signal and module 232 may not include the A/D converter.

Module 232 may optionally include a user interface (not shown), e.g., a keyboard, a mouse, a remote control and/or any type of user-interface as are known in the art. Module 232 may include any other software and/or hardware, e.g., as are known in the art.

According to some demonstrative embodiments of the invention, system 200 may also include a converter 219 to convert the image data of signals 212 into sub-pixel data signals 239 representing the image in terms of at least four primary colors.

Certain aspects of methods and devices for converting image data in three-primary video formats into a at-least-three-primary format, in accordance with exemplary embodiments of the invention, are described in International Application PCT/IL02/00410, filed May 23, 2002, entitled "DEVICE, SYSTEM AND METHOD OF DATA CONVERSION FOR WIDE GAMUT DISPLAYS" and published 12 Dec. 2002 as PCT Publication WO 02/099557, the disclosure of which is incorporated herein by reference.

According to some demonstrative embodiments of the invention system 200 may also include a sub-pixel processor 229, and a LCD panel 202, as are described in detail below.

Processor 229 may include any suitable processor, e.g., an ASIC, a FPGA, a Central Processing Unit (CPU), a Digital Signal Processor (DSP), a microprocessor, a host processor, a plurality of processors, a controller, a chip, a microchip, or any other suitable multi-purpose or specific processor or controller.

According to some demonstrative embodiments of the invention, processor 229 may generate signals 249 based on the MP sub-pixel data of signals 239. Processor 229 may generate signals 249 in a three-primary sub-pixel configuration, e.g., corresponding to a sub-pixel configuration of LCD panel 202, e.g., as described in detail below.

Some exemplary embodiments of the invention are described herein in relation to activating drivers of an array of LC elements, e.g., which may be part of a LCD panel. However, it will be appreciated by those skilled in the art, that other embodiments of the invention may be implemented for activating drivers of any other array of sub-pixel elements.

According to some demonstrative embodiments of the invention, panel 202 may include an array 208 of sub-pixel elements, e.g., LC elements (cells) 204, for example, an LC array using Thin Film Transistor (TFT) active-matrix technology, as is known in the art. For example, each of cells 204 may be connected to a horizontal ("row") line (not shown) and a vertical ("column") line (not shown), as are known in the art.

Panel 202 may also include a first set of electronic circuits 210 ("row drivers") associated with the row lines, and a second set of electronic circuits 206 ("column drivers") associated with the column lines. Drivers 210 and 206 may be implemented for driving the cells of array 208, e.g., by active-matrix addressing, as is known in the art.

According to some demonstrative embodiments of the invention, panel 202 may also include an n-primary-color filter array 216, which may be, for example, juxtaposed to array 208. Panel 202 may include any other suitable configuration of sub-pixel elements.

According to exemplary embodiments of the invention, panel 202 may also include a timing controller (TCON) 218 to receive signals 249 and to adjust the magnitude of a signal 220 delivered to the different column drivers 206 based on the sub-pixel data of signals 249. TCON 118 may also provide drivers 210 with a timing signal 222 to controllably activate rows of LC array 208, e.g., as is known in the art. TCON 218 may include, for example, a standard TCON able to control drivers 210 and/or 220 in accordance with the three-primary sub-pixel configuration of signals 249. The intensity of white light, e.g., provided by a back-illumination source (not shown), may be spatially modulated by LC array 208, selectively attenuating the light for each sub pixel according to the desired intensity of the sub-pixel. The selectively attenuated light passes through MP color filter array 216, wherein each LC cell is in registry with a corresponding color sub-pixel, producing desired color sub-pixel combinations. The human vision system spatially integrates the light filtered through the different color sub-pixels to perceive a color image.

According to some demonstrative embodiments of the invention, array 208 may include a standard TFT backplane, e.g., wherein each square pixel may be represented by three TFT LCD sub-pixels. Thus, each sub-pixel may have an aspect ratio 3:1, e.g., between the width of the sub-pixel and the height of the sub-pixel. Accordingly, array 208 may include 3×N×M, e.g., if the resolution of the panel is M×N pixels in terms of three-primary sub-pixels, where traditionally (but not necessarily) each pixel is divided along video lines, creating 3×M sub-pixels per video line.

According to some demonstrative embodiments of the invention, in order to produce an LCD panel capable of reproducing all the sub-pixels of MP sub-pixel data 239, some considerable modifications may be required compared to a standard RGB LCD panel, for example:

1. Changing the TFT backplane design, to contain more sub-pixels for each pixel of the actual display resolution.
2. Changing the number of data (column) drivers in order to support more sub-pixels per line/column.
3. Additional color filters for the extra primary colors are to be implemented upon the relevant sub-pixels of the panel.

According to some demonstrative embodiments of the invention, it may be desired to avoid one or more of the above modifications, e.g., since they may be relatively complex. Moreover, those adaptations might also affect the price of each panel, due to the additional number of electronic devices and design, thus reducing the cost/effectiveness of the MPC technology in the price-competitive LCD market.

Implementing some demonstrative embodiments of the invention may avoid, for example, the changing of the TFT backplane design, and/or the changing of the number of data (column) drivers. This may be achieved, for example, by system 200 which may include the standard TFT backplane, TCON, and/or drivers, while only the standard RGB filter arrays are replaced with MP filter array 216. This may enable a low-cost solution for MP technology implementation in the LCD market, e.g., while maintaining high quality of color and/or image.

Since array 208 may include only M×3 physical sub-pixels, it looks like the native number of sub-pixels may be reduced by a ratio of $3/N_p$ (where $N_p>3$ is the number of primaries or fundamental colors of the display). More over, each MP pixel group now, containing $N_p$ sub-pixels, lost the 1:1 aspect ratio. It will be understood that the term pixel as used in this application may refer to a grouping of sub-pixels that are formed from a common data set. A pixel group may contain one, more than one, or less than one, sub-pixel of any fundamental color.

A scaling or mapping of M pixels to $M\times3/N_p$ pixels may be performed, for example, before conversion of the three-primary data. Accordingly, each line of M (RGB) pixels may be scaled to $M\times3/N_p$ RGB pixels, which may be converted into $M\times3/N_p$ MP pixels. The $M\times3/N_p$ pixels correspond to $M\times3/N_p\times N_p=M\times3$ sub-pixels, which are the number of physical sub-pixels on the panel. Alternatively, the scaling or mapping may be performed on the MP data, e.g., after the conversion of the three-primary data into the MP data.

It will be appreciated by those skilled in the art, that the scaling/mapping procedures described above may suffer from reduced, e.g., horizontal, resolution compared to the resolution of the input three-primary data. The reduction of resolution may be the result of the following:

1. The reduced number of "native" MP pixels in a line compared to the original pixel resolution;
2. The regular scaling procedure from one resolution to another may suffer from aliasing artifacts.

According to some demonstrative embodiments of the invention, processor 229 may scale the MP sub-pixel data of signals 239, for example, based on knowledge of the arrangement of sub-pixel filter in panel 216; and/or utilizing sub-pixel rendering algorithms, for example, in order to enhance resolution, e.g., in terms of image luminance.

Additionally or alternatively, according to some demonstrative embodiments of the invention processor 229 may utilize characteristics of MP color reproduction, in order to deal with sub-pixel chromaticity fringes, and/or any other phenomena, which may result, for example, from the reduction of resolution for pure color object. Such phenomena may include, for example, aliasing of high-frequency object in pure colors, and/or "mesh effect" reduced uniformity of saturated color areas, due to the reduced density of pure color elements per area.

According to some demonstrative embodiments of the invention, each line of array 204 may include 3×M cells, while each line of multi-primary sub-pixel data 239 may correspond to $N_p$×M sub-pixels. Accordingly, the scaling of the data of signals 239 to signals 249 may result in less "full" MP pixels than the original data pixels for each line, e.g., in a factor of 3/k.

According to some demonstrative embodiments of the invention, processor 229 may scale the M multi-primary pixels per line of signals 239, into signals 249 including M×3/k MP sub-pixels per line.

A common method to scale higher resolution data (M>M×3/k), may include re-sampling the data at the position of the new lower resolution pixels, e.g., as is known in the art. Inevitably, since the new sampling rate is lower, the new data has less resolution, and may suffer aliasing.

According to some demonstrative embodiments of the invention, processor 229 may re-sample the data of signals 239 presuming, for each pixel, that the whole data, luminance and/or chromaticity, are given at the center of both the "original pixel" (e.g., the pixel represented by the data of signals 239) and the "new pixel" (e.g., the pixel re-sampled pixel represented by signals 249 corresponding to the original pixel). Thus the resolution of the sampling may be the distance between adjacent pixel centers.

According to some demonstrative embodiments of the invention, re-sampling the original sub-pixel data of signals 239, while considering the centers of the new sub-pixels, may result in the resample rate to be even higher then the original one, thus allowing a better reconstruction of the original resolution. Each sub-pixel may be considered, for example, as lying on the center of a "white" or luminance pixel, e.g., formed by a sequence of three sub-pixels. Accordingly, the luminance of the original image may be reconstructed, and the resolution may be improved, e.g., for objects that contain gray tones and/or non-saturated colors. Thus, according to embodiments of the invention, a data set including a plurality of more than three data points, representing the intensity values of the available colors may be used to represent a data for a pixel group. However, the pixel group may contain less sub-pixels than the number of data points. Various methods are described herein in accordance with the present invention for displaying the data sets having more than three data points to the display having more than three primary or fundamental colors.

According to some demonstrative embodiments of the invention, processor 229 may apply to one or more sub-pixel values of the MP sub-pixel data of signals 239 a suitable convolution function, which may be based for example, on a predetermined set of weights which may be assigned to sub-pixel values of neighboring pixels and/or sub-pixels, e.g., as described below.

Figure 3:
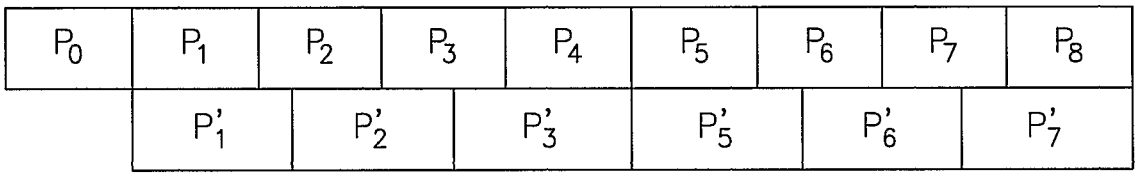
FIG. 3 is a conceptual illustration of re-sampling multi-primary sub-pixel data, in accordance with some demonstrative embodiments of the invention.

Reference is also made to FIG. 3, which conceptually illustrates re-sampling of the MP sub-pixel data of signal 239 (the "MP sub-pixel data") into the sub-pixel data of signal 249 ("the re-sampled data"), in accordance with some demonstrative embodiments of the invention.

According to some demonstrative embodiments of the invention, the MP sub-pixel data of signal 239 may relate to a sequence of pixels, for example, e.g., including nine MP pixels denoted $P_0$, $P_1$, $P_2$, $P_3$, $P_4$, $P_5$, $P_6$, $P_7$, and $P_8$, respectively. Each of the pixels may be represented, for example, by at least four sub-pixel values corresponding to at least four primary colors, respectively. For example, an n-th pixel, $P_n$, may be represented as follows:

$$P_n=[p^0_n,p^1_n,p^2_n,p^3_n] \tag{1}$$

wherein $p^0_n$, $p^1_n$, $p^2_n$, and $p^3_n$ denote sub-pixel values corresponding to four primary colors, respectively.

According to some demonstrative examples of the invention, processor 229 may determine a set of re-sampled MP pixels corresponding to the MP sub-pixel data of signal 239. Processor 229 may be able to re-sample, for example, a sequence of L multi-primary pixels of signal 239 into a sequence M×3/k multi-primary pixels. For example, if signal 239 includes four-primary sub-pixel data, then processor 229 may sample eight MP pixels, e.g., pixels $P_1$, $P_2$, $P_3$, $P_4$, $P_5$, $P_6$, $P_7$, and $P_8$, into a sequence of re-sampled pixels, e.g., including six re-sampled MP pixels denoted $P'_1$, $P'_2$, $P'_3$, $P'_5$, $P'_6$, and $P'_7$, respectively. Each of the re-sampled pixels may be represented, for example, by at least four sub-pixel values corresponding to at least four primary colors, respectively. For example, an n-th re-sampled pixel, $P'_n$, may be represented as follows:

$$P'_n=[p'^0_n,p'^1_n,p'^2_n,p'^3_n] \tag{2}$$

wherein $p'^0_n$, $p'^1_n$, $p'^2_n$, and $p'^3_n$ denote sub-pixel values corresponding to four primary colors, respectively.

According to some demonstrative embodiments of the invention, processor 229 may format the data of the re-sampled pixels in a three-primary configuration, e.g., represented by sets of three sub-pixels values. For example, processor 229 may format the six re-sampled pixels $P'_1$, $P'_2$, $P'_3$, $P'_5$, $P'_6$, and $P'_7$, which may include 24 sub-pixel values, in eight sets of three sub-pixel values, e.g., corresponding to eight pixels of panel 204. Processor 229 may implement any suitable formatting algorithm and/or method.

According to some demonstrative embodiments of the invention, processor 229 may implement any suitable method and/or algorithm to re-sample the MP pixels of signal 239 into the re-sampled MP pixels, e.g., as described below.

According to some demonstrative embodiments of the invention, the luminance resolution may be increased, e.g., beyond that of the original RGB display, for example, using the fact that each MP pixel contains several sub-sets of sub-pixels that can produce white-like combination, given a high enough resolution of the data.

According to some demonstrative embodiments of the invention, processor 229 may apply the following one-dimensional convolution matrix to determine the pixel $P'_n$ based on one or more pixels of the MP sub-pixel data of signal 239:

$$[p'^0_n,p'^1_n,p'^2_n,p'^3_n]=W^n_0\cdot[p^0_{n+1},p^1_{n-1},p^2_{n-1},p^3_{n-1}]+W^n_1\cdot[p^0_n,p^1_n,p^2_n,p^3_n]+W^n_2\cdot[p^0_{n+1},p^1_{n+1},p^2_{n+1},p^3_{n+1}]+W^n_3\cdot[p^0_{n+2},p^1_{n+2},p^2_{n+2},p^3_{n+2}] \tag{3}$$

Equation 3 may be re-written as follows:

$$P'_n=W^n_0\cdot P_{n-1}+W^n_1\cdot P_n+W^n_2\cdot P_{n+1}+W^n_3\cdot P_{n+2} \tag{4}$$

Equation 4 may be re-written as follows:

$$P'_n=\sum_{j=0}^{3} W^n_j\cdot P_{n-1+j} \tag{5}$$

wherein $W^n_j$, wherein j=0 . . . 3, denote a plurality of predetermined weights corresponding to the n-th sub-pixel and to a plurality of the MP pixels $P_{n-1+j}$ of signal 239. For example, processor 229 may determine the values of re-sampled pixel $P'_1$, based on the weight $W^n_0$, representing the pixel $P'_1$ and the neighboring pixel $P_0$; the weight $W^n_1$, representing the pixels $P'_1$ and $P_1$; the weight $W^n_2$, representing the pixel $P'_1$ and the neighboring pixel $P_2$; and the weight $W^n_3$, representing the pixel $P'_1$ and the neighboring pixel $P_3$.

According to some demonstrative embodiments of the invention, processor 229 may apply different weight values $W^n_j$ to the sub-pixel values of signal 239, e.g., according to the primary color corresponding to the sub-pixels. This may be in contrast to conventional re-sampling methods, in which same weights may be applied to all sub-pixels of a sampled pixel. Accordingly, each sub-pixel may have different a weight, e.g., depending also on its position within the pixel. For example, if filter array 216 has a four-primary pixel configuration of RGBY, then the R sub-pixel component of the re-sampled pixel $P'_n$ may be more effected from the R value of the pixel $P_n$, e.g., since the R element is positioned on the left hand side of the pixel $P_n$; while the Y value of re-sampled pixel $P'_n$, may be more effected from the Y value of pixel $P_{n+1}$, since the Y element is positioned on the right hand side of $P_n$.

Thus, according to some demonstrative embodiments of the invention, the convolution matrix implemented by processor 229 to determine the sub-pixel values of re-sampled pixel $P'_n$ may be based on a plurality of weights representing the pixel, one or more neighboring pixels, and/or the color of the sub-pixel. For example, processor 229 may determine the re-sampled pixel $P'_n$ as follows, e.g., if signal 239 include four-primary sub-pixel data:

$$\begin{aligned}[p'^0_n, p'^1_n, p'^2_n, p'^3_n] = {} & [W^n_0\{C(p^0_{n-1})\}\cdot p^0_{n-1}, W^n_0\{C(p^1_{n-1})\}\cdot p^1_{n-1}, W^n_0\{C(p^2_{n-1})\}\cdot p^2_{n-1}, W^n_0\{C(p^3_{n-1})\}\cdot p^3_{n-1}] + [W^n_1\{C(p^0_n)\}\cdot p^0_n, W^n_1\{C(p^1_n)\}\cdot p^1_n, W^n_1\{C(p^2_n)\}\cdot p^2_n, W^n_1\{C(p^3_n)\}\cdot p^3_n] + \\ & [W^n_2\{C(p^0_{n+1})\}\cdot p^0_{n+1}, W^n_2\{C(p^1_{n+1})\}p^1_{n+1}, W^n_2\{C(p^2_{n+1})\}p^2_{n+1}, W^n_2\{C(p^3_{n+1})\}p^3_{n+1}] + \\ & [W^n_3\{C(p^0_{n+2})\}\cdot p^0_{n+2}, W^n_3\{C(p^1_{n+2})\}\cdot p^1_{n+2}, W^n_3\{C(p^2_{n+2})\}\cdot p^2_{n+2}, W^n_3\{C(p^3_{n+2})\}\cdot p^3_{n+2}]\end{aligned} \quad (6)$$

wherein $C(p^0_{n-1})$, $C(p^1_{n-1})$, $C(p^2_{n-1})$, $C(p^3_{n-1})$, $C(p^0_n)$, $C(p^1_n)$, $C(p^2_n)$, $C(p^3_n)$, $C(p^0_{n+1})$, $C(p^1_{n+1})$, $C(p^2_{n+1})$, $C(p^3_{n+1})$, $C(p^0_{n+2})$, $C(p^1_{n+2})$, $C(p^2_{n+2})$, and $C(p^3_{n+2})$ denote the primary colors assigned to sub-pixels $p^0_{n-1}$, $p^1_{n-1}$, $p^2_{n-1}$, $p^3_{n-1}$, $p^0_n$, $p^1_n$, $p^2_n$, $p^3_n$, $p^0_{n+1}$, $p^1_{n+1}$, $p^2_{n+1}$, $p^3_{n+1}$, $p^0_{n+2}$, $p^1_{n+2}$, $p^2_{n+2}$, and $p^3_{n+2}$, respectively; $W^n_0\{C(p^0_{n-1})\}$, $W^n_0\{C(p^1_{n-1})\}$, $W^n_0\{C(p^2_{n-1})\}$, $W^n_0\{C(p^3_{n-1})\}$, denote weights assigned based on the colors $C(p^0_{n-1})$, $C(p^1_{n-1})$, $C(p^2_{n-1})$, and $C(p^3_{n-1})$, respectively, and the pixel $P_0$; $W^n_1\{C(p^0_n)\}$, $W^n_1\{C(p^1_n)\}$, $W^n_1\{C(p^2_n)\}$, and $W^n_1\{C(p^3_n)\}$ denote weights assigned based on the colors $C(p^0_n)$, $C(p^1_n)$, $C(p^2_n)$, and $C(p^3_n)$, respectively, and the pixel $P_1$; $W^n_2\{C(p^0_{n+1})\}$, $W^n_2\{C(p^1_{n+1})\}$, $W^n_2\{C(p^2_{n+1})\}$, $W^n_2\{C(p^3_{n+1})\}$ denote weights assigned based on the colors $C(p^0_{n+1})$, $C(p^1_{n+1})$, $C(p^2_{n+1})$, and $C(p^3_{n+1})$, respectively, and the pixel $P_2$; and $W^n_3\{C(p^0_{n+2})\}$, $W^n_3\{C(p^1_{n+2})\}$, $W^n_3\{C(p^2_{n+2})\}$, and $W^n_3\{C(p^3_{n+2})\}$ denote weights assigned based on the colors $C(p^0_{n+2})$, $C(p^1_{n+2})$, $C(p^2_{n+2})$, and $C(p^3_{n+2})$, respectively, and the pixel $P_3$.

According to other demonstrative embodiments of the invention, processor 229 may apply to the MP sub-pixel data of signals 239 any other suitable convolution function, e.g., a two-dimensional convolution matrix. For example, if filter array 216 includes a staggered configuration of sub-pixels, e.g., wherein odd and even lines include different sub-pixel color sequences, the convolution matrices may be switched between odd and even lines, e.g., to match the different configuration of each line.

According to some exemplary embodiments of the invention, processor 229 may also implement, for example, one or more sub-pixel inter-pixel rendering methods, e.g., as are described below.

In multi-primary displays, there may be some sub-sets of sub-pixels that may be used to create gray and/or non-saturated colors. For example, white may be created using RGB, or using CYR. Other colors using two or three color combinations may be possible. Thus, in order to avoid "mesh" problems on uniform non-saturated areas, methods and systems of the present invention may balance the luminance uniformity over a pixel, by balancing it between two different sub-sets within the pixel.

In some embodiments of the invention, for example, in order to improve uniformity and/or resolution, for saturated color image objects, some of the primary colors may be reconstructed using a combination of other sub-pixels having different colors. For example, yellow may be reproduced using red and green; cyan may be reproduced using green and blue, e.g., as described in International Application PCT/IL2004/001123 filed Dec. 13, 2004 entitled "MULTI-PRIMARY LIQUID CRYSTAL DISPLAY", and published 23 Jun. 2005 as PCT Publication WO 2005/057532, the entire disclosure of which is incorporated herein by reference. Thus, although the "native" MP pixel on is larger than the "native" original pixel, e.g., by a factor of k/3 for k multi-primaries, each MP sub pixel can contain, for example, two different elements for yellow, for example Y and R+G, thereby enhancing the actual yellow resolution. In some embodiments, a color may be unexpressed in a pixel group, in which case the color may be displayed using a combination of sub-pixels that may form the color. For example, in a pixel group that does not contain a Y sub-pixel, intensity values of RG sub-pixels in the pixel group may be calculated to take into consideration not only the red and green data points of the pixel group's data set, but also the yellow data point in the pixel group's data set.

The previous attribute of MP color reproduction may also be also used, additionally or alternatively with the sub-pixel resampling mentioned above, for example, in order to reconstruct high-resolution features and edges. For example, on a five-color RGBYC configuration, if there is a sharp yellow edge originally located at the left-hand side of this MP pixel group, the position of the element may be reconstructed more accurately using the RG pair of sub-pixels, in addition to the Y sub-pixel. This may be useful, for example, in reconstructing elements that exist in graphical contents and PC-generates images, which may be as narrow as one-pixel width element.

High frequency graphical elements, like computer-generated presentations, can also use a special preset, that can be a little less saturated, thus allowing more-then-one participating sub-pixels per pixel, that along with the sub-pixel resampling will allow better perceived resolution, and avoid "mesh" effects.

For graphical elements, some compensation algorithm as discussed above within the pixel, might also take into account the spatial data of nearby pixels and of other primaries data, in order to choose which kind of inter-pixel sub pixel compensation should be used, e.g., as described in the above-referenced documents.

Inter-pixel sub-pixel rendering may be used, for example, in order to reduce and/or correct chromaticity fringes that may arise from the sub-sampling process. This rendering may include one, some or all of the following methods: a running average in the sub-pixel level; using different sub-sets within the pixel group in order to correct for position in accuracies; using spatial filters and data of adjacent or nearby pixel groups in order to calculate inter-pixel compensation.

Embodiments of the present invention may be implemented by software, by hardware, or by any combination of software and/or hardware as may be suitable for specific applications or in accordance with specific design requirements. Embodiments of the present invention may include units and sub-units, which may be separate of each other or combined together, in whole or in part, and may be implemented using specific, multi-purpose or general processors, or devices as are known in the art. Some embodiments of the present invention may include buffers, registers, storage units and/or memory units, for temporary or long-term storage of data and/or in order to facilitate the operation of a specific embodiment.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A method of displaying an image on a display having a plurality of sub-pixels, each of said sub-pixels being aligned with a filter having a color selected from a set of more than three different colors, none of which is white, comprising:

providing first and second pixel data sets, said pixel data sets each having more than three data points and corresponding to first and second adjacent pixel groups respectively, said pixel groups including a plurality of sub-pixels;

for at least one sub-pixel in said first pixel group, calculating an intensity value based at least on a weighted average of a first data point, said first data point included in said first pixel data set and corresponding to the color of the filter aligned with said sub-pixel, and a second data point, said second data point included in said second pixel data set, wherein a weight in said weighted average depends at least in part on a position of the sub-pixel within the pixel group relative to another sub-pixel in the pixel group.

2. The method of claim 1, further comprising:

receiving first and second three-color data sets, each of said three-color data sets including exactly three data points; and converting said first and second three-color data sets using a conversion algorithm to obtain said pixel data set, each of said pixel data sets including more than three data points.

3. The method of claim 1, wherein said second data point is an intensity value in said second pixel group corresponding to the color of the filter aligned with said sub-pixel.

4. The method of claim 1, wherein each of said pixel groups includes fewer sub-pixels than the number of data points in said pixel data sets.

5. The method of claim 1, wherein calculating the intensity value of said sub-pixel is further based on a third data point, said third data point corresponding to a color different than the color of the filter aligned with said sub-pixel.

6. The method of claim 5, wherein said third data point is included in said first data set and corresponds to a color that is not present among the filters aligned with sub-pixels in said first pixel group.

7. The method of claim 6, wherein calculating said intensity value comprises calculating a weighted average of said first and said second and said third data points.

8. The method of claim 1, wherein calculating the intensity value of said sub-pixel is further based on a fourth data point, said fourth data point included in a third data set corresponding to a third pixel group and corresponding to the color of the filter aligned with the sub-pixel.

9. The method of claim 8, wherein said third pixel group is adjacent said first pixel group.

10. The method of claim 8, wherein said third pixel group is adjacent said second pixel group.

11. The method of claim 1, comprising repeating said calculating for a plurality of sub-pixels in said first pixel group.

12. The method of claim 11, further comprising for at least a second sub-pixel in said first pixel group, providing an intensity value for said second sub-pixel using solely a data point in said first pixel data set corresponding to the color of the filter aligned with said second sub-pixel.

13. The method of claim 11, comprising calculating said intensity values for a plurality of pixel groups in said display.

14. A system comprising:

a display having a plurality of sub-pixels, each said sub-pixel aligned with a corresponding color filter, wherein said display includes filters having more than three different colors, none of said colors being white;

a data converter to convert a first data set having exactly three data points to a second data set having more than three data points, wherein said second data set corresponds to a pixel group including a plurality of sub-pixels on said display; and a scaling processor to calculate for at least a portion of sub-pixels in each pixel group corresponding to said second data set an intensity value based on a weighted average of at least a data point in said second data set corresponding to the color of said sub-pixel and a data point in an additional data set, wherein a weight in said weighted average depends at least in part on a position of the sub-pixel within the pixel group relative to another sub-pixel in the pixel group.

15. The system of claim 14, further comprising a timing controller to provide said intensity values to sub-pixels.

16. The system of claim 15, wherein said sub-pixels are liquid crystal elements.

17. The system of claim 16, wherein said liquid crystal elements are controlled by thin film transistors.

18. The system of claim 14, wherein the number of sub-pixels in each pixel group is fewer than the number of different colors in said display.

19. The system of claim 18, wherein said additional data set corresponds to a data set for a pixel group adjacent said pixel group.

20. The system of claim 19, wherein said scaling processor is to calculate said intensity value for said sub-pixel based at least on said data point in said additional data set, wherein said data point in said additional data set corresponds within said additional data set to the color of the filter aligned with said sub-pixel.

21. The system of claim 14, wherein said scaling processor is to calculate for another portion of sub-pixels in said pixel group an intensity value based solely on a data point in said second data set corresponding to the color of said sub-pixel.

22. The system of claim 21, wherein said another portion of sub-pixels comprises the sub-pixel located at the center of the pixel group.

23. The system of claim 14, wherein said scaling processor is further to calculate for at least a portion of sub-pixels in each pixel group corresponding to said second data set an intensity value based at least a third data point in a third data set.

24. The system of claim 23, wherein said third data set corresponds to a pixel group adjacent a pixel group in which said sub-pixel is located.

25. The system of claim 23, wherein said third data set corresponds to a pixel group adjacent a pixel group corresponding to said additional data set.

* * * * *